US008714279B2

(12) United States Patent
Nagasaka et al.

(10) Patent No.: US 8,714,279 B2
(45) Date of Patent: May 6, 2014

(54) IMPACT TOOL

(75) Inventors: Hidenori Nagasaka, Aichi (JP); Takuji Kimura, Aichi (JP); Katsushi Miyashita, Aichi (JP)

(73) Assignee: Makita Corporation, Anjo-shi (JP)

( * ) Notice: Subject to any disclaimer, the term of this patent is extended or adjusted under 35 U.S.C. 154(b) by 1377 days.

(21) Appl. No.: 11/348,472

(22) Filed: Feb. 7, 2006

(65) Prior Publication Data

US 2006/0180327 A1 Aug. 17, 2006

(30) Foreign Application Priority Data

Feb. 14, 2005 (JP) ..... 2005-036636

(51) Int. Cl.
*B25D 15/02* (2006.01)

(52) U.S. Cl.
USPC ..... 173/104; 173/109

(58) Field of Classification Search
USPC ..... 173/48, 104, 109, 217, 216; 408/124
See application file for complete search history.

(56) References Cited

U.S. PATENT DOCUMENTS

| | | | | |
|---|---|---|---|---|
| 3,908,139 | A | 9/1975 | Duncan, Jr. | |
| 4,081,704 | A | 3/1978 | Vassos et al. | |
| 4,189,011 | A * | 2/1980 | Eberle | 173/13 |
| 5,033,552 | A | 7/1991 | Hu | |
| 5,056,607 | A * | 10/1991 | Sanders | 173/48 |
| 5,624,000 | A | 4/1997 | Miller | |
| 5,975,218 | A | 11/1999 | Liau et al. | |
| 6,039,126 | A | 3/2000 | Hsieh | |
| 6,394,191 | B1 | 5/2002 | Nakane | |
| 6,457,535 | B1 * | 10/2002 | Tanaka | 173/48 |
| 6,725,945 | B2 * | 4/2004 | Sugimoto et al. | 173/117 |
| 7,131,503 | B2 * | 11/2006 | Furuta et al. | 173/48 |
| 2003/0089510 | A1 | 5/2003 | Sugimoto et al. | |
| 2003/0121676 | A1 | 7/2003 | Ortt et al. | |
| 2003/0159843 | A1 * | 8/2003 | Sakai et al. | 173/216 |
| 2005/0173139 | A1 | 8/2005 | Furuta et al. | |
| 2005/0183870 | A1 * | 8/2005 | Wada et al. | 173/128 |
| 2005/0236170 | A1 * | 10/2005 | Lee | 173/216 |

FOREIGN PATENT DOCUMENTS

| | | | |
|---|---|---|---|
| CN | 1575932 | A | 2/2005 |
| CN | 1575932 | A * | 2/2005 |
| EP | 0 906 812 | A2 | 4/1999 |

(Continued)

OTHER PUBLICATIONS

May 17, 2013 Office Action issued in U.S. Appl. No. 13/614,687.

(Continued)

*Primary Examiner* — Thanh Truong
*Assistant Examiner* — Nathaniel Chukwurah
(74) *Attorney, Agent, or Firm* — Oliff PLC

(57) ABSTRACT

An impact tool includes a motor, a hammer casing with an opened rear end and a disk-shaped member coupled to the hammer casing to close the opened rear end and to rotatably support a spindle. A first engagement member is formed on an outer face of the disk-shaped member. A second engagement member is formed on an inner face of the recess and engaging with the first engagement member to restrict a movement of the hammer casing in a second direction parallel to a rotation axis of the spindle. A third engagement member is formed on an outer face of the hammer casing. A fourth engagement member is formed on an inner face of the housing body and engaging with the third engagement member so as to restrict a movement of the hammer casing in the first direction.

10 Claims, 3 Drawing Sheets

(56) References Cited

FOREIGN PATENT DOCUMENTS

| | | |
|---|---|---|
| JP | A-7-148669 | 10/1995 |
| JP | A 2003-145439 | 5/2003 |
| JP | A-2005-231005 | 9/2005 |

OTHER PUBLICATIONS

Notification of Reason for Refusal w/English-language translation, issued Aug. 17, 2010.
Dec. 10, 2013 Office Action issued in U.S. Appl. No. 13/614,687.

* cited by examiner

IMPACT TOOL

BACKGROUND OF THE INVENTION

The present invention relates to an impact tool in which a hammer casing installed with an impact mechanism is mounted on a front section of a housing body housing a motor.

For example, Japanese Patent Publication No. 2003-145439A discloses an impact driver in which an internal gear casing and a hammer casing are mounted on a front section of a housing body which houses a motor. In the hammer casing, an impact mechanism is installed. This impact mechanism comprises: a spindle operable to rotate to transmit a power from an output axis of the motor by way of a planetary reduction gear mechanism; a hammer coupled to an outer periphery of the spindle so as to be movable in an axial direction of the spindle and so as to rotate together with the spindle; and an anvil disposed in a front side of the hammer so as to project toward a front side of the hammer casing. The hammer is urged toward the anvil by a coiled spring so that an engaging claw provided on a front face of the hammer is engaged with an arm provided on a rear end of the anvil.

With this configuration, when the motor is driven to rotate the spindle, the anvil is accordingly rotated by way of the hammer, so that a screwing operation can be performed by a bit attached on the anvil. If an excessive load is imparted on the anvil at a final stage of the screwing operation, the hammer is retracted against the urging force of the coiled spring and disengaged from the anvil. The disengaged hammer is then rotated together with the spindle and proceeded toward the anvil with the aid of the urging force of the coiled spring to again engage with the anvil. The disengagement and re-engagement are repeated to provide intermittent impacts on the anvil, thereby additional screwing forces are applied to finalize the screwing operation.

On the other hand, the internal gear casing is fixed on the housing body by screwing. Male screw portions provided on an outer periphery of a front end of the internal gear casing is screwed into female screw portions provided on an inner periphery of a rear end of the hammer casing, so that the internal gear casing and the hammer casing are coupled to each other. The undesired movement of the hammer casing relative to the internal gear casing in a circumferential direction thereof is prevented by fixing a lack on a lower face of the hammer casing in the housing body with screws in order to cause the lack to mesh with dimples provided on the outer periphery of the hammer casing.

In the above impact driver, since the fixation of the internal gear casing with respect to the housing body, and the fixation of the hammer casing with respect to the housing body are separately performed, and since the undesired rotation of the hammer casing relative to the housing body is prevented with different parts. Therefore, the number of parts will be naturally increased, and the assembling work well be troublesome. Further, there is a probability that the parts are fallen out when the impact driver is disassembled for the maintenance purpose.

Since the internal gear casing is covered with the hammer casing after the internal gear casing is fixed on the housing body with screws, it is difficult to downsize the hammer casing. Accordingly, the operability and the workability are not so good at a narrow space, for example.

SUMMARY OF THE INVENTION

It is therefore an object of the invention to provide a downsized impact tool in which an assembling structure of a hammer casing is simplified; and inner parts are prevented from being fallen out.

In order to achieve the above object, according to the invention, there is provided an impact tool, comprising:

a housing body, having a recess;

a motor, housed in the housing body at a rear side of the recess;

a hammer casing, housing a rotatable spindle and an impact mechanism operable to convert the rotation of the spindle into intermittent impact actions in a first direction which is a circumferential direction of the spindle, and having an opened rear end, the hammer casing mounted in the recess;

a disk-shaped member, coupled to the hammer casing so as to close the opened rear end and to rotatably support the spindle, the disk-shaped member having a through hole receiving an output axis of the motor, thereby causing the output axis of the motor to couple with the spindle to transmit a rotation of the motor to rotate the spindle;

a first engagement member, formed on an outer face of the disk-shaped member;

a second engagement member, formed on an inner face of the recess and engaging with the first engagement member so as to restrict a movement of the hammer casing in a second direction parallel to a rotation axis of the spindle;

a third engagement member, formed on an outer face of the hammer casing; and a fourth engagement member, formed on an inner face of the housing body and engaging with the third engagement member so as to restrict a movement of the hammer casing in the first direction.

With the above configuration, at the same time as the hammer casing is mounted in the recess, the restrictions for the rotation in the first direction and the movement in the second direction can be effected. Accordingly, not only the number of parts can be decreased but also the assembling workability can be enhanced. Especially, since the disk-shaped member is integrated with the hammer casing housing the impact mechanism as a unit, not only the parts of the impact mechanism can be prevented from falling out even when the impact tool is disassembled for the maintenance purpose, but also the downsizing of the hammer casing can be attained, thereby enhancing the operability and workability at a narrow space.

The first engagement member may be a flange and the second engagement member may be a groove receiving the flange.

With this configuration, the structure for restricting the movement of the hammer casing in the second direction can be easily provided with a less space.

Here, the flange may have a polygonal cross section in a third direction perpendicular to the second direction.

With this configuration, the disk-shaped member can be rotated for attaching to or detaching from the hammer casing through the use of the polygonal flange.

The third engagement member may be a first rib projected from the outer face of the hammer casing, and the fourth engagement member may be a second rib coming into contact with the first rib in the first direction.

With this configuration, the structure for restricting the rotation of the hammer casing in the first direction can be provided by efficiently utilizing a given space (e.g., a space for housing another unit).

The outer face of the hammer casing may include a first curved face and a first flat face which serves as the third engagement member. The inner face of the housing body may include a second curved face and a second flat face which comes in contact with the first flat face to serve as the fourth engagement member.

With this configuration, the undesired rotation of the hammer casing can be reliably avoided.

Here, a projection may be formed on one of the first flat face and the second flat face. A recess receiving the projection may be formed on the other one of the first flat face and the second flat face.

With this configuration, the contact state between the first flat face and the second flat face can be secured and stabilized.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Figure 1:
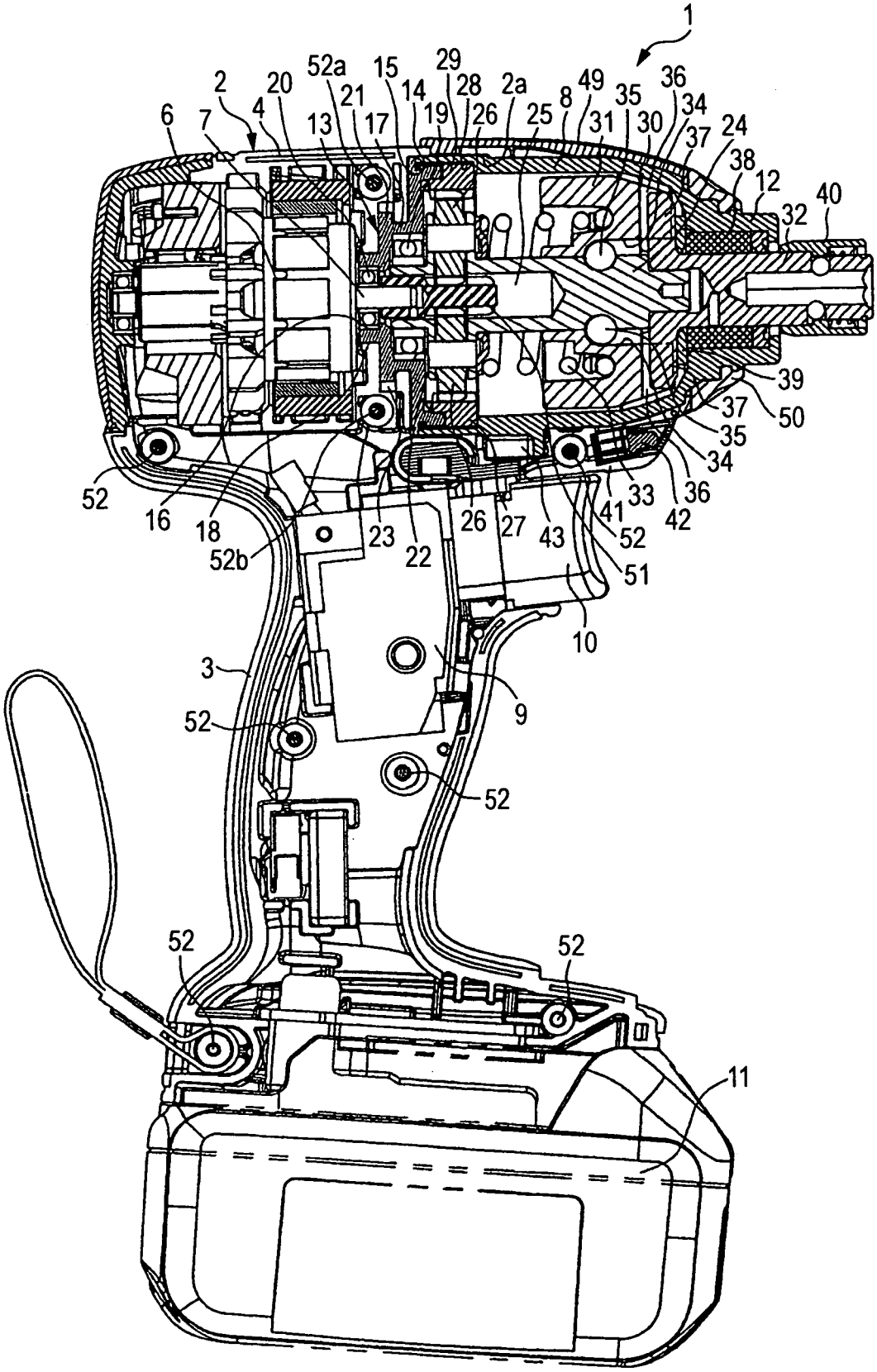
FIG. 1 is a vertical section view of an impact driver according to one embodiment of the invention.

As shown in FIG. 1, an impact driver 1 according to one embodiment of the invention is roughly constituted by right and left half housings 4, 5 (see also FIG. 4) and a housing body 2 provided with a handle section 3 extending downward. A motor 6 is housed in a rear section (left side in FIG. 1) of the housing body 2. A hammer casing 8 in which an impact mechanism 30 is disposed is mounted on a mount section 2*a* of the housing body 2 which is shaped into a bottomed cylinder at a front side of the motor 6. Reference numerals 9, 10 and 11 denotes a switch, a trigger and a battery, respectively.

The hammer casing 8 is a bell-shaped member cylindrical member. A cylinder 12 having a relatively small diameter is formed at a front end of the hammer casing 8. A bearing box 13 shaped into a circular cap is integrally coupled to the hammer casing 8 so as to close a rear opening of the hammer casing 8. Specifically, a female thread 14 is formed on an inner periphery of the opened rear end of the hammer casing 8 and a male thread 15 is formed on an outer periphery of a front end of the bearing box. The coupling of the bearing box 13 and the hammer casing 8 is performed by screwing the male thread 15 into the female thread 14, so that the rear section of the hammer casing 8 is closed except a through hole 16 formed at a center portion of the bearing box 13.

Figure 2:
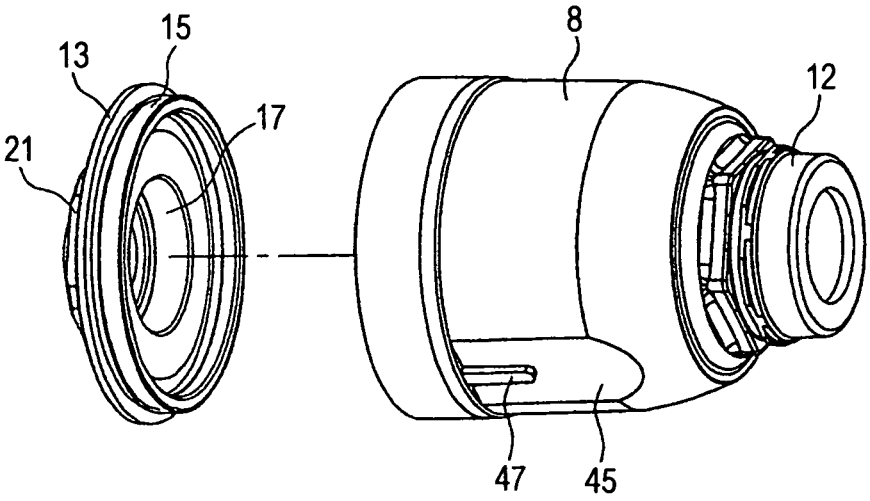
FIG. 2 is a perspective view of a hammer casing and a bearing box in the impact driver, showing a disassembled state.
Figure 3:
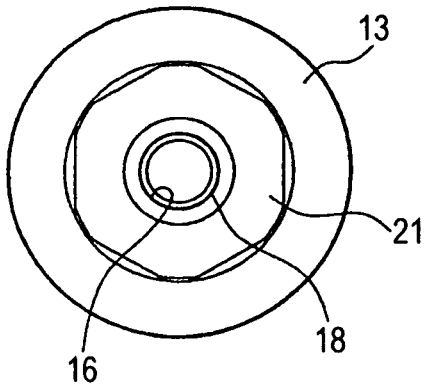
FIG. 3 is a rear side view of the bearing box.

The bearing box 13 has a two-stage structure in which a diameter is reduced stepwise toward the rear side thereof. Specifically, the bearing box 13 has a large diameter section 17 holding a ball bearing 19 therein and a small diameter section 18 holding a ball bearing 20 therein. As shown in FIGS. 2 and 3, at an outer periphery of a rear end of the large diameter section 17, a hexagonal flange 21 is coaxially provided. On the other hand, in a central part of the bottom of the mount section 2*a*, a recess 22 having a two-stage structure adapted to receive the bearing box 13. At a portion in the recess 22 to be oppose the flange 21 is formed with a groove 23, so that the flange 21 engages with the groove 23 when the bearing box 13 is fitted into the recess 22. With this structure, the hammer casing 8 coupled with the bearing box 13 is prevented from falling off forward. Since the flange 21 shaped into hexagonal, it is easily rotate the large diameter section 17 to detach the bearing box 13 from the hammer casing 8 in order to perform the maintenance work for the impact mechanism 30.

A spindle 24 having a hollowed portion 25 at a rear end thereof is axially housed in the hammer casing 8. The ball bearing 19 held by the large diameter section 17 supports an outer periphery of the rear end of the spindle 24. In a front side of the ball bearing 19, a pair of planetary gears 26 are supported by the spindle 24 in a point symmetrical relationship relative to an axis of the spindle 24. The planetary gears 26 are exposed to the hollowed space 25 and adapted to mesh with a pinion 51 of an output axis of the motor 6 which is placed in the hollowed space 25 in the assembled condition.

The planetary gears 26 mesh with an internal gear 27 held in the hammer casing 8. Grooves 28 are formed on the inner periphery of the rear end portion of the hammer casing 8 so as to extend in the axial direction of the hammer casing 8. Ribs 29 are formed on an outer periphery of the internal gear 27 so as to extend in an axial direction of the internal gear 27. Fitting the ribs 29 into the grooves 28, the internal gear 27 is held in the hammer casing 8 while being prevented from rotating.

The impact mechanism 30 comprises: the spindle 24; a hammer 31 fitted on an outer periphery of the spindle 24; an anvil 32 coaxially held by the cylinder 12 in the front side of the hammer 31; and a coiled spring 33 urging the hammer 31 forward. Guide grooves 34 are formed on an inner periphery of a front end portion of the hammer 31 so as to extend in an axial direction of the hammer 31. Steel balls 35 are fitted onto the outer periphery of the spindle 24. Fitting the steel balls 35 into the guide grooves 34, the hammer 31 is coupled with the spindle 24 so as to be rotatable together and movable in the axial direction.

Engagement claws 36 are projected from a front face of the hammer 31. A pair of arms 37 are formed on a rear end of the anvil 32 so as to extend in a radial direction of the anvil 32. The hammer 31 is urged by the coiled spring 33 to such a position that the claws 36 can engage with the arms 37 as a result of the movement in a circumferential direction of the anvil 32. A front end of the spindle 24 is loosely and coaxially inserted into a hole formed in the rear section of the anvil 32.

Reference numeral 38 denotes a bearing provided in the cylinder 12. Reference numeral 39 denotes a washer interposed between the cylinder 12 and the arms 37 to regulate a front position of the anvil 32. Reference numeral 40 denotes a chuck sleeve provided for detachably fit a bit into a mount hole formed on a front end of the anvil 32.

Figure 4:
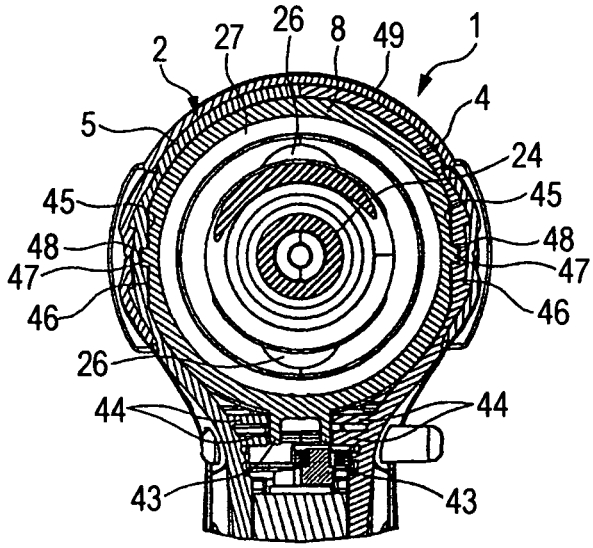
FIG. 4 is a lateral section view of the impact driver.

In the body housing 2 opposing a lower face of the hammer casing 8, an extended portion 41 is provided so as to extend forward to cover a part of the lower face. A light unit 42 is provided in a front side of the extended portion 41 and is connected to a drive circuit of the motor 6 so that it is turned on when the motor 6 is driven to illuminate a front side of the anvil 32. As shown in FIG. 4, in the extended portion 41, a pair of vertical ribs 43 are projected downward and extended in a front-rear direction. Front ends of the vertical ribs 43 are made continuous. Ribs 44 are formed on an inner face of each of the half housings 4, 5 forming the extended portion 41 so as to extend laterally. The horizontal ribs 44 are abutted against an outer face of each of the vertical ribs 43. According to this interference between the vertical ribs 43 and 44 in the circumferential direction, unnecessary rotation of the hammer casing 8 can be prevented.

Tapered sections 45 are formed on lateral outer faces of the hammer casing 8 so as to extend parallel to each other. In the mount section 2*a* to be covered with the hammer casing 8, flat portions 46 are formed so as to oppose the tapered sections 45. In a central portion of each of the tapered sections 45, a projection 47 is formed so as to extend in the front-rear direction. On the other hand, in each of the flat portions 46, a groove 48 into which the projection 47 is fitted is formed. Thus, the undesired rotation of the hammer casing 8 is prevented also by the abutment between the tapered sections 45 and the flat portions 46 and by the engagement between the projections 47 and the grooves 48.

As shown in FIG. 1, a cover 49 made of synthetic resin is detachably mounted on the hammer casing 8 to prevent the user from contacting the hammer casing 8 which becomes high temperature at working, thereby maintaining good operability. An annular damper 50 made of rubber is attached on a proximal end of the cylinder 12 of the hammer casing 8 in the front side of the cover 49. Covering the front end portion of the hammer casing 8 with the damper 50, damage on a worked object due to the collision of the hammer casing 8 at working can be avoided.

When the impact driver 1 as configured the above is assembled, the bearing box 13 holding the ball bearing 19 is coupled with the hammer casing 8 installed with the impact mechanism 30, the planetary gears 26 and the internal gear 27 in a screwing manner. As a result, an assembled unit containing parts disposed in the front side of the ball bearing 19 is obtained. Here, since the rear end of the hammer casing 8 is closed except the through hole 16 formed in the central portion of the bearing box 13, internal parts can be prevented from falling out therefrom.

Next, the motor 6 is coupled to the rear section of the hammer casing 8 such that the output axis 7 attached with the ball bearing 20 and the pinion 51 is inserted into the through hole 16. Here, the pinion 51 enters the hollowed portion 25 in the spindle 24 and meshes with the planetary gears 26, and the ball bearing 20 is held by the small diameter section 18 of the bearing box 13. Thus, the motor 6 and the above assembled unit are integrated. In this state, the integrated unit is mounted on a prescribed position in one of the half housings 4, 5 such that the flange 21 on the bearing box 13 is fitted into the groove 23. One of the vertical ribs 43 is placed on the horizontal ribs 44 formed in the extended portion 41, thereby the tapered section 45 and the flat portion 46 are opposed to each other.

After the switch 9 and so on are assembled, the other one of the half housings 4, 5 is mounted so as to cover the above integrated unit and fixed with screws 52. Since screws 52*a*, 52*b* are arranged between the motor 6 and the hammer casing 8 and in an outer side of the large diameter section 17 of the bearing box 13, dead spaces formed by the bearing box 13 can be efficiently utilized and it is possible to avoid upsizing of the housing body 2 in the front-rear direction for obtaining screwing positions.

With the above assembling work, the vertical ribs 43 are held between the horizontal ribs 44, and the projections 47 are fitted into the grooves 48. Thus, restrictions for rotation in the circumferential direction and movement in the front-rear direction of the hammer casing 8 can be effected at the same time.

When the trigger 10 is actuated, the motor 6 is driven and the spindle 24 is rotated. The anvil 32 is accordingly rotated by way of the hammer 31 so that screwing work with the bit attached on the anvil can be performed. When a load imparting on the anvil 32 exceeds a threshold level at the final stage of the screwing work, the hammer 31 is retracted rearward against the urging force of the coiled spring 33 and disengaged from the anvil 32. But immediately thereafter, the hammer 31 again proceeds forward in accordance with the urging force of the coiled spring 33 while being rotated with the spindle 24, and then the claws 36 again engage with the arms 37 on the anvil 32. The above disengagement and engagement are repeated so that intermittent impacts are provided in the circumferential direction of the anvil 32 and additional screwing forces are applied to finalize the screwing operation.

As has been described the above, in the impact driver 1 according to this embodiment, the bearing box 13 supporting the spindle 24 and formed with the through hole 16 adapted to receive the output axis 7 of the motor 6 is integrally coupled with the rear end section of the hammer casing 8. In addition, the flange 21 is formed on the rear face of the bearing box 13 and the groove 21 is formed on the recess 22 in the mount section 2*a*. The hammer casing 8 is prevented from moving forward by the engagement between the flange 21 and the groove 23. Moreover, the members for preventing the hammer casing 8 from moving in the circumferential direction thereof are provided on the housing body 2 and the hammer casing 8. Thus, at the same time as the hammer casing 8 is mounted on the housing body 2, the restrictions for the rotation in the circumferential direction and the movement in the forward-rear direction can be effected. Accordingly, not only the number of parts can be decreased but also the assembling workability can be enhanced. Especially, since the bearing box 13 is integrated with the hammer casing 8 housing the impact mechanism 30 as a unit, not only the parts of the impact mechanism 30 can be prevented from falling out even when the impact driver 1 is disassembled for the maintenance purpose, but also the downsizing of the hammer casing 8 can be attained, thereby enhancing the operability and workability at a narrow space.

Since the structure for restricting the movement of the hammer casing 8 in the front-rear direction is embodied by the flange 21 formed on the large diameter section 17 of the bearing box 13 and the groove 23 formed on the mount section 2*a* and adapted to receive the flange 21, such a structure can be easily provided with a less space. Especially, since the flange 21 is shaped into hexagonal, the bearing box 13 can be rotated for attaching to or detaching from the hammer casing 8 through the use of the flange 21.

Since the structure for restricting the rotation of the hammer casing 8 in the circumferential direction is embodied by the vertical ribs 43 projected from the outer face of the hammer casing 8 and disposed in the extended portion 41, and the horizontal ribs 44 formed on the inner face of the extended portion 41 and adapted to come in contact with the vertical ribs 43, such a structure can be provided by efficiently utilizing a given space.

In addition, the tapered sections 45 formed on the outer face of the hammer casing 8 and the flat portions 46 formed on the inner face of the mount section 2*a* covering the hammer casing 8 and adapted to come in contact with the tapered sections 45 also constitutes the structure for restricting the rotation of the hammer casing 8. The undesired rotation of the hammer casing 8 can be reliably avoided. Especially, since the projection 47 is formed on each of the tapered sections 45 and the groove 48 adapted to receive the projection 47 is formed on each of the flat portions 46, the contact state between the tapered sections 45 and the flat portions 46 can be secured and stabilized.

A plurality of flanges and grooves for restricting the front-rear movement of the hammer casing 8 may be arranged in the front-rear direction. The flange 21 may be a projection which is partly provided on the outer face of the bearing box 13. The groove 23 may be formed so as to adapt to receive such a projection. To the contrary to the above embodiment, the flange 21 may be formed on the mount section 2*a* and the groove 23 may be formed on the bearing box 13.

The flange 21 may not be hexagonal only if the rotating work of the bearing box 13 is still facilitated, that is, it may be shaped into other polygon such as rectangle and pentagon. Alternatively, the flange 21 may be circular but holes may be formed in the rear face of the flange 21 so that a jig can be inserted into the holes to rotate the bearing box 13.

As to the structure for restricting the rotation of the hammer casing 8, the number and the extending direction of the vertical ribs 43 and the horizontal ribs 44 may be arbitrary only if the interference between such members in the circumferential direction can be effected. Similarly, the number and the positions of the tapered sections 45 and the flat portions 46 may be arbitrary. To the contrary to the above embodiment, the projections 47 may be formed on the flat portions 46 and the grooves 48 may be formed on the tapered sections 45. The number and the positions of the projections 47 and the grooves 48 may be arbitrary and may be omitted.

One of the combination of the vertical ribs 43 and the horizontal ribs 44 and the combination of the tapered sections 45 and the flat portions 46 for restricting the rotation of the hammer casing 8 may be omitted only if the undesired rotation of the hammer casing 8 can be reliably prevented.

The shape of the hammer casing 8, the structure of the planetary gears 26 and the impact mechanism 30 installed therein are not limited to the configuration as described the above. The bearing of the spindle 24 may be a needle bearing. A plurality of planetary reduction gear mechanisms may be arranged in the front-rear direction of the housing body 2. The internal gear 27 may be held by the bearing box 13. The impact tool may be driven by alternating current.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A method for assembling an impact tool, comprising:

providing a housing body housing a motor;

housing a rotatable spindle and an impact mechanism operable to convert the rotation of the spindle into intermittent impact actions in a first direction which is a circumferential direction of the spindle, in a hammer casing having an opened rear end and being independent from the housing body;

closing the opened rear end of the hammer casing with a rear cover so as to rotatably support the spindle, thereby forming a front unit;

coupling the front unit with the housing body by engaging a first engagement member formed on an outer circumferential face of the rear cover and a second engagement member formed on an inner face of the housing body and engaging with the first engagement member, so that a movement of the front unit relative to the housing body in a second direction parallel to a rotation axis of the spindle is restricted, and inserting an output axis of the motor into a through hole formed in the rear cover, thereby coupling the output axis of the motor with the spindle.

2. The method as set forth in claim 1, further comprising:

engaging a third engagement member formed on an outer face hammer casing and a forth engagement member, formed on an inner face housing body and engaging with the third engagement member, so that a movement of the front unit in the first direction is restricted.

3. An impact tool, comprising:

a hammer casing, housing a rotatable spindle and an impact mechanism operable to convert the rotation of the spindle into intermittent impact actions in a first direction which is a circumferential direction of the spindle, and having an opened rear end;

a rear cover, coupled to the hammer casing and closing the opened rear end so as to rotatably support the spindle, the rear cover having a through hole;

a motor, having an output axis extending through the through hole and coupled with the spindle to transmit a rotation of the motor to rotate the spindle;

a housing body, housing the motor, being independent from the hammer casing and coupled to a rear side of the rear cover;

a first engagement member, formed on an outer circumferential face of the rear cover; and a second engagement member, formed on an inner face of the housing body and engaging with the first engagement member so as to restrict a movement of the rear cover relative to the housing body in a second direction parallel to a rotation axis of the spindle.

4. The impact tool as set forth in claim 3, wherein the first engagement member is a flange which is monolithically formed with the rear cover, and the second engagement member is a groove receiving the flange.

5. The impact tool as set forth in claim 4, wherein the flange has a polygonal cross section in a third direction perpendicular to the second direction.

6. The impact tool as set forth in claim 4, wherein the flange is concentric with the through hole.

7. The impact tool as set forth in claim 3, further comprising:

a third engagement member, formed on an outer face of the hammer casing; and a fourth engagement member, formed on an inner face of the housing body and engaging with the third engagement member so as to restrict a movement of the hammer casing in the first direction.

8. The impact tool as set forth in claim 7, wherein the third engagement member is a first rib projected from the outer face of the hammer casing, and the fourth engagement member is a second rib coming into contact with the first rib in the first direction.

9. The impact tool as set forth in claim 7, wherein:

the outer face of the hammer casing includes a first curved face and a first flat face which serves as the third engagement member; and the inner face of the housing body includes a second curved face and a second flat face which comes in contact with the first flat face to serve as the fourth engagement member.

10. The impact tool as set forth in claim 9, wherein:

a projection is formed on one of the first flat face and the second flat face; and a recess receiving the projection is formed on the other one of the first flat face and the second flat face.

* * * * *